US006918686B2

(12) United States Patent
Wu

(10) Patent No.: US 6,918,686 B2
(45) Date of Patent: Jul. 19, 2005

(54) ASSEMBLED LAMP RETAINING DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 110 days.

(21) Appl. No.: 10/402,794

(22) Filed: Mar. 29, 2003

(65) Prior Publication Data

US 2004/0190297 A1 Sep. 30, 2004

(51) Int. Cl.[7] ..... H01R 33/00

(52) U.S. Cl. ..... 362/459; 362/405; 362/406; 362/458; 362/404; 362/402

(58) Field of Search ..... 362/404, 402, 362/403, 407, 405, 406, 458; 248/344

(56) References Cited

U.S. PATENT DOCUMENTS 4,300,732 A * 11/1981 Gaeta ..... 242/379.2
6,612,531 B2 * 9/2003 Wu ..... 248/317
6,758,577 B2 * 7/2004 Wu ..... 362/226
6,780,050 B1 * 8/2004 Wu ..... 439/544
6,851,830 B2 * 2/2005 Wu ..... 362/226
2003/0227776 A1 * 12/2003 Lin ..... 362/402

* cited by examiner

*Primary Examiner*—Stephen Husar
*Assistant Examiner*—Anabel Ton

(57) ABSTRACT

An assembled lamp retaining device comprises a lamp seat, a limiting structure and a lamp rod. In the limiting structure, a pin passes through an upper locking hole of the lamp seat, a limiting block and a tension spring above the limiting block so as to confine the limiting block and the tension spring to the lamp seat. A vertical surface of the limiting block is formed with a through hole and a lower end thereof is protruded with a buckling sheet. One end of the buckling sheet is an inclined surface and another end of the buckling sheet is an inclined stepped surface. The tension spring is between two vertical sides of the limiting block. Thereby, the limiting block is positioned; and thus, the lamp rod can be assembled or detached from the lamp seat easily.

3 Claims, 3 Drawing Sheets

Fig. 1-A

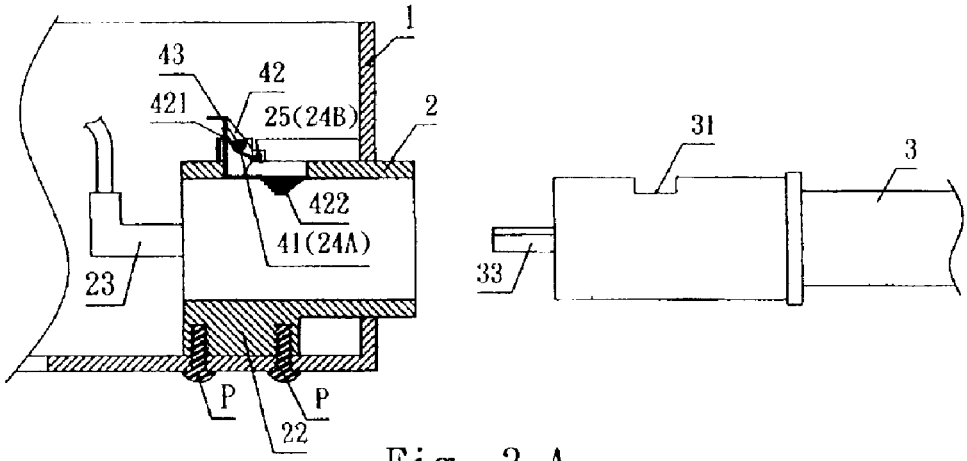
Fig. 3-A
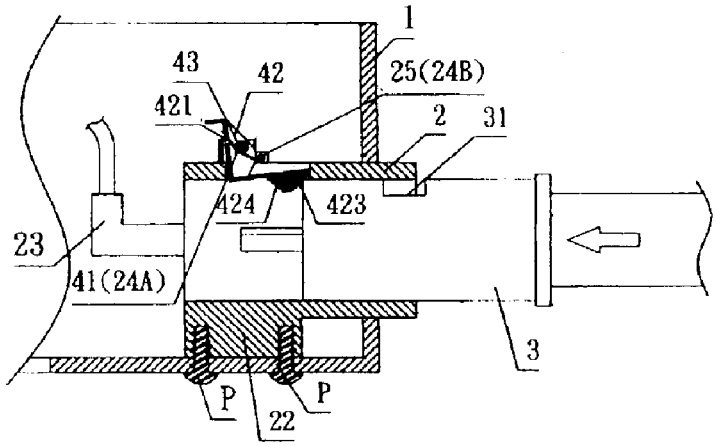
Fig. 3-B
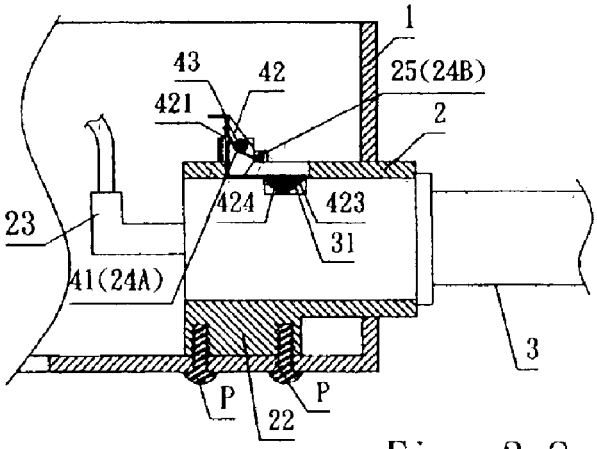
Fig. 3-C

ASSEMBLED LAMP RETAINING DEVICE

FIELD OF THE INVENTION

The present invention relates to lamp assembly devices, and particularly to an assembled lamp retaining device. By the design of the present invention, a user can assembled the lamp rod by inserting it into the lamp seat easily. Thus, the lamp is detachable for storage and transfer with a smaller volume.

BACKGROUND OF THE INVENTION

The prior art buckling structures of lamps, such as wall lamp's, seat lamps, or stand lamps, are assembled by screwing studs with nuts. Not only the collision accident easy occurs, but also the locking tools (for example, spanners, openers, etc.) are necessarily in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide an assembled lamp retaining device which comprises a lamp seat, a limiting structure and a lamp rod. In the limiting structure, a pin passes through an upper locking hole of the lamp seat, a limiting block and a tension spring above the limiting block so as to confine the limiting block and the tension spring to the lamp seat. A vertical surface of the limiting block is formed with a through hole and a lower end thereof is protruded with a buckling sheet. One end of the buckling sheet is an inclined surface and another end of the buckling sheet is an inclined stepped surface so as to retaining the lamp rod. The tension spring is between two vertical sides of the limiting block. One end of the tension spring is confined above the through hole and another end of the tension spring is confined at a lower end of the pin passing through the lower locking hole of the lamp seat; thereby, the limiting block is positioned; and thus, the lamp rod can be assembled or detached from the lamp seat easily.

The various objects and advantages of the present invention will be more readily understood from the following detailed description when read in conjunction with the appended drawing.

BRIEF DESCRIPTION OF THE DRAWINGS

FIG. 1A is a partial enlarged view of the present invention.

FIG. 3A is a plane cross section view showing the insertion of lamp rod of the present invention.

FIG. 3B is a plane cross section view showing a view in assembling the lamp rod.

FIG. 3C is a plane cross section view showing a view after the lamp rod is inserted.

BRIEF DESCRIPTION OF THE PREFERRED EMBODIMENTS

Figure 1:
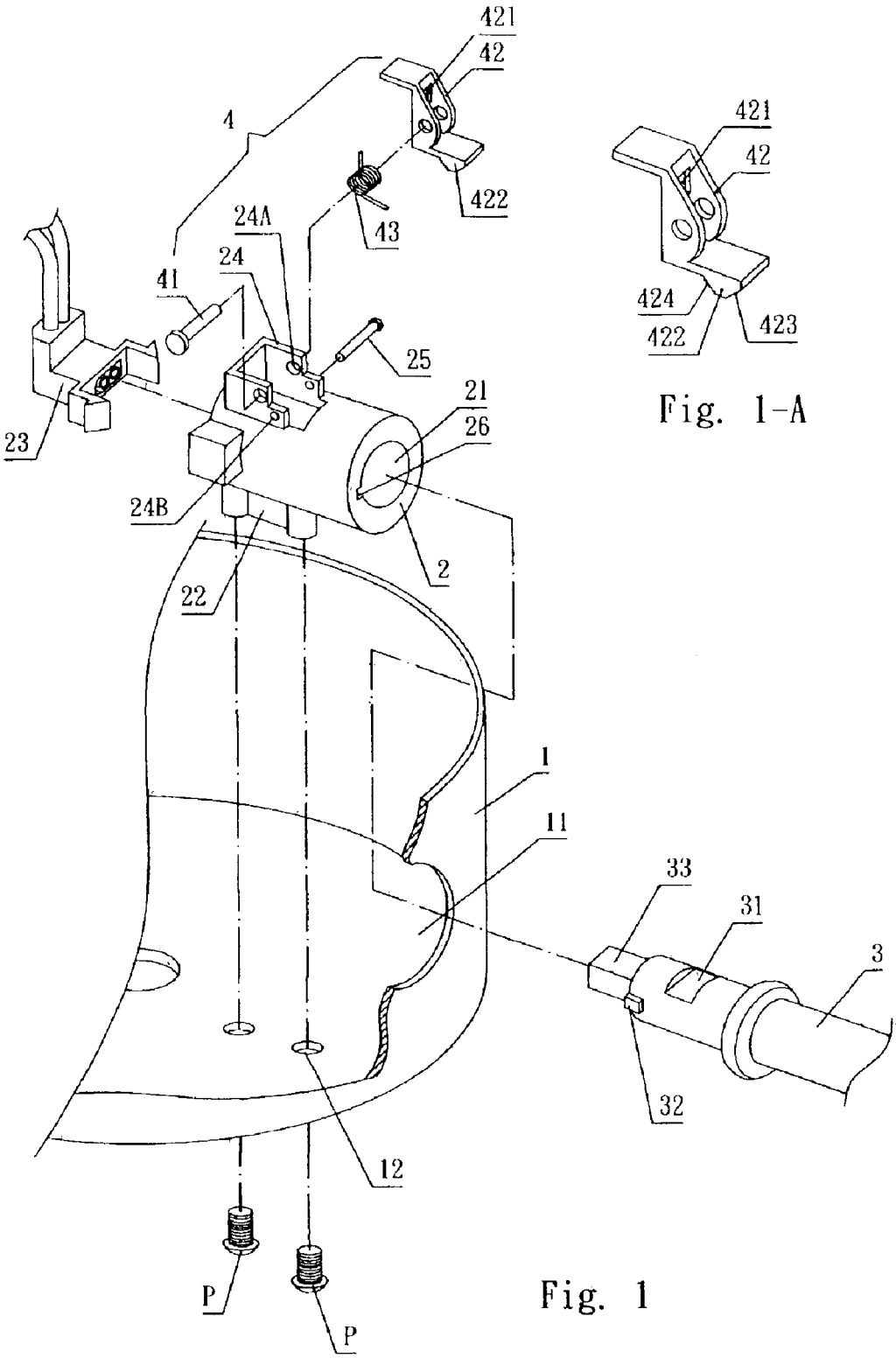
FIG. 1 is an exploded perspective view of the present invention.
Figure 2:
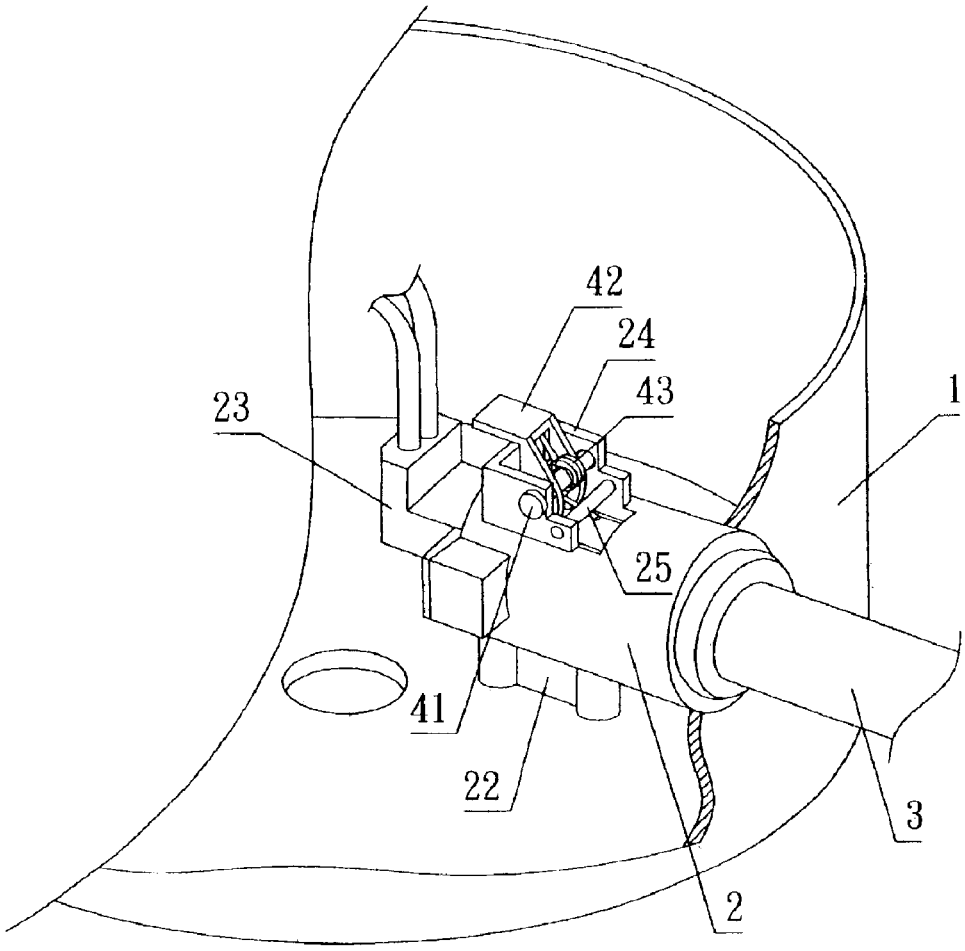
FIG. 2 is an assembled perspective view of the present invention.

Referring to FIGS. 1 and 2, the locking device for locking a lamp rod of the present invention is illustrated. The locking device includes a lamp seat 2 firmly secured to a lateral side of a wire winding box 1, a limiting structure 4 within the lamp seat 2 and a lamp rod 3 inserted into the lamp seat 2.

A lateral side of the wire winding box 1 has a via hole 11 and a bottom of the wire winding box 1 coupled to the lamp seat 2 has a screw hole 12 for being passed by a stud P so as to lock the lamp seat 2 to a predetermined positioned.

A portion of the lamp seat 2 coupled to the via hole 11 of the wire winding box 1 has a penetrating hole 21 and a bottom of the lamp seat 2 protrudes with a locking seat 22 with a configuration corresponding to the screw hole 12 of the wire winding box 1, thereby the stud P can pass through the screw hole 12 from a lower end of the wire winding box 1 and then is locked to the locking seat 22 so as to fix the lamp seat 2 to the wire winding box 1. A distal end of the lamp seat 2 is locked with an inserting seat 23 which is exactly resisted by the end portion 33 of the lamp rod 3. In assembly, the inserting seat 23 is installed with electric wires and then it is placed in a mold for shaping so that the wire is firmly secured in the inserting seat 23. A top of the lamp seat 2 is protruded with a pivotal seat 24 and an upper lock hole 24A and a lower lock hole 24B are formed on the upper and lower sides of the pivotal seat 23. A pin passes through the lower lock hole 24B in advance for retaining the limit structure 4. At an inner wall of the penetrating hole 21 is formed with an axial recess 26 for buckling the lamp rod 4.

In the limiting structure 4, a pin 41 passes through the upper locking hole 24A of the lamp seat 2, a limiting block 42 and a tension spring 42 above the limiting block 42 so as to confine the limiting block 42 and the tension spring 43 to the lamp seat 2. A vertical surface of the limiting block 42 is formed with a through hole 421 and a lower end thereof is protruded with a buckling sheet 422. One end of the buckling sheet 422 is an inclined surface 423 and another end of the buckling sheet 422 is an inclined stepped surface 424 so as to retaining the lamp rod 3. The tension spring 43 is between two vertical sides of the limiting block 42. One end of the tension spring 43 is confined above the through hole 421 and another end of the tension spring 43 is confined at a lower end of the pin 25 passing through the lower locking hole of the lamp seat 2. Thereby, the limiting block 42 is positioned.

In the present invention, an end of the slot has a teeth surface for buckling the limiting structure so as to prevent the lamp from falling downwards. Moreover, in the present invention, the penetrating hole is a rectangular hole.

A portion of the lamp rod 3 coupled to the limiting structure 4 of the lamp seat 2 is formed with a slot 31. After the lamp rod 3 inserts into the penetrating hole 21, the end portion 33 of the lamp rod 3 will touch the buckling inclined surface 423 so as to push the buckling sheet 422 upwards. After the lamp rod 3 passes through the penetrating hole, the resilient force of the tension spring 242 will return the buckling sheet 422 to an original position so that the slot 31 of the lamp rod 3 buckles the inclined stepped surface 424 of the buckling sheet. Moreover, the lamp rod 3 has a buckling block 32 at a position corresponding to the axial recess 26. The buckling block 32 can pass through the axial recess 26 for confining the rotation of the lamp rod 3.

Referring to FIG. 3, when the lamp rod 3 passes through the penetrating hole 21 of the lamp seat 2, the insertion portion of the lamp rod 3 pushes the buckling sheet 422 upwards so that the block will press the tension spring 34 to deform (referring to FIG. 3B). When the lamp rod 3 has inserted into the lamp seat 2 completely, the limiting block 42 restores the buckling sheet 422 to the original position by the resilient force of the tension spring 242 so that the slot 31 of the lamp rod 3 is buckled to the inclined stepped surface 424 of the buckling sheet 422. Thereby, the ceiling lamp will not fall down due to weak support. Thus the lamp rod 3 is confined to the lamp seat 2. At this time, the end portion of the lamp seat 2 is exactly coupled to the inserting seat 23 of the lamp seat 2. Thus, the lamp seat 2 is conductive to the lamp rod 3 (referring to FIG. 3C).

By assembling the lamp seat 2 (for assembling the lamp rod 3) into the wire winding box 1 in advance, the user can insert the lamp rod 3 into the lamp seat 2 of the wire winding box 1 for use without using any studs.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An assembled lamp retaining device comprising a lamp seat firmly secured to a lateral side of a wire winding box, a limiting structure within the lamp seat and a lamp rod inserted into the lamp seat; wherein a lateral side of the wire winding box has a via hole; and a portion of the lamp seat is coupled to the via hole of the wire winding box for installed a lamp rod;

a distal end of the lamp seat is locked with an inserting seat which is exactly resisted by an end portion of the lamp rod; a top of the lamp seat is protruded with a pivotal seat and an upper lock hole and a lower lock hole are formed in upper and lower sides of the pivotal seat; a pin passes through the lower lock hole in advance for retaining the limiting structure;

in the limiting structure, a pin passes through the upper locking hole of the lamp seat, a limiting block and a tension spring above the limiting block so as to confine the limiting block and the tension spring to the lamp seat; a vertical surface of the limiting block is formed with a through hole and a lower end thereof is protruded with a buckling sheet; one end of the buckling sheet is an inclined surface and another end of the buckling sheet is an inclined stepped surface so as to retaining the lamp rod; the tension spring is between two vertical sides of the limiting block; one end of the tension spring is confined above the through hole and another end of the tension spring is confined at a lower end of the pin passing through the lower locking hole of the lamp seat; thereby, the limiting block is positioned; and thus, the lamp rod can be assembled or detached from the lamp seat easily;

wherein an end of the slot has a teeth surface for buckling the limiting structure so as to prevent the lamp from falling downwards.

2. An assembled lamp retaining device comprising a lamp seat firmly secured to a lateral side of a wire winding box, a limiting structure within the lamp seat and a lamp rod inserted into the lamp seat; wherein a lateral side of the wire winding box has a via hole; and a portion of the lamp seat is coupled to the via hole of the wire winding box for installed a lamp rod;

a distal end of the lamp seat is locked with an inserting seat which is exactly resisted by an end portion of the lamp rod; a top of the lamp seat is protruded with a pivotal seat and an upper lock hole and a lower lock hole are formed in upper and lower sides of the pivotal seat; a pin passes through the lower lock hole in advance for retaining the limiting structure;

in the limiting structure, a pin passes through the upper locking hole of the lamp seat, a limiting block and a tension spring above the limiting block so as to confine the limiting block and the tension spring to the lamp seat; a vertical surface of the limiting block is formed with a through hole and a lower end thereof is protruded with a buckling sheet; one end of the buckling sheet is an inclined surface and another end of the buckling sheet is an inclined stepped surface so as to retaining the lamp rod; the tension spring is between two vertical sides of the limiting block; one end of the tension spring is confined above the through hole and another end of the tension spring is confined at a lower end of the pin passing through the lower locking hole of the lamp seat; thereby, the limiting block is positioned; and thus, the lamp rod can be assembled or detached from the lamp seat easily;

wherein a bottom of the wire winding box coupled to the lamp seat has a screw hole; a bottom of the lamp seat protrudes with a locking seat with a configuration corresponding to the screw hole of the wire winding box; thereby a stud passes through the screw hole from a lower end of the wire winding box and then is locked to the locking seat so as to fix the lamp seat to the wire winding box.

3. An assembled lamp retaining device comprising a lamp seat firmly secured to a lateral side of a wire winding box, a limiting structure within the lamp seat and a lamp rod inserted into the lamp seat; wherein a lateral side of the wire winding box has a via hole; and a portion of the lamp seat is coupled to the via hole of the wire winding box for installed a lamp rod;

a distal end of the lamp seat is locked with an inserting seat which is exactly resisted by an end portion of the lamp rod; a top of the lamp seat is protruded with a pivotal seat and an upper lock hole and a lower lock hole are formed in upper and lower sides of the pivotal seat; a pin passes through the lower lock hole in advance for retaining the limiting structure;

in the limiting structure, a pin passes through the upper locking hole of the lamp seat, a limiting block and a tension spring above the limiting block so as to confine the limiting block and the tension spring to the lamp seat; a vertical surface of the limiting block is formed with a through hole and a lower end thereof is protruded with a buckling sheet; one end of the buckling sheet is an inclined surface and another end of the buckling sheet is an inclined stepped surface so as to retaining the lamp rod; the tension spring is between two vertical sides of the limiting block; one end of the tension spring is confined above the through hole and another end of the tension spring is confined at a lower end of the pin passing through the lower locking hole of the lamp seat; thereby, the limiting block is positioned; and thus, the lamp rod can be assembled or detached from the lamp seat easily;

wherein at an inner wall of the penetrating hole is formed with an axial recess for buckling the lamp rod, the lamp rod has a buckling block at a position corresponding to the axial recess; the buckling block can pass through the axial recess for confining the rotation of the lamp rod.

* * * * *